United States Patent [19]

Kong

[11] 4,157,142

[45] Jun. 5, 1979

[54] SAFETY CONTAINER OPENING MEANS

[76] Inventor: Cheung T. Kong, 269 S. Lafayette Park Pl., Apt. 304, Los Angeles, Calif. 90057

[21] Appl. No.: 929,261

[22] Filed: Jul. 31, 1978

[51] Int. Cl.[2] ..... B65D 55/02; B65D 85/56; H61J 1/00

[52] U.S. Cl. ..... 215/223; 215/206; 215/350

[58] Field of Search ..... 215/206, 222, 223, 350, 215/224

[56] References Cited

U.S. PATENT DOCUMENTS

| | | | |
|---|---|---|---|
| 3,749,270 | 7/1973 | Affleck | 215/223 X |
| 4,053,078 | 10/1977 | Herr | 215/222 |
| 4,071,156 | 1/1978 | Lowe | 215/206 X |
| 4,095,718 | 6/1978 | Kong | 215/223 |

*Primary Examiner*—George T. Hall

*Attorney, Agent, or Firm*—Christie, Parker & Hale

[57] ABSTRACT

A combination for containing medicine and the like provides a convertible feature such that a selection can be made between, on the one hand, a precautionary arrangement to prevent children from obtaining access to the medicine and, on the other hand, an easy open arrangement.

2 Claims, 7 Drawing Figures

Fig. 1
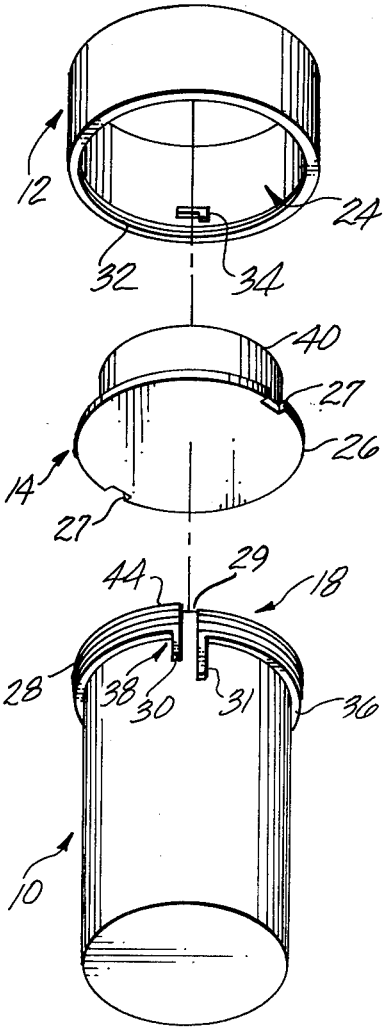
Fig. 3
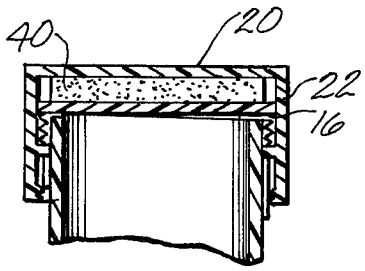
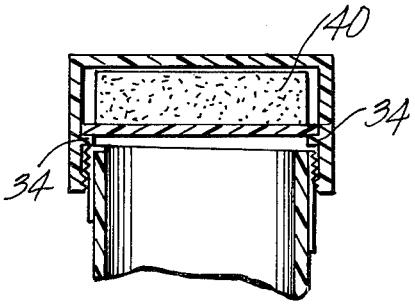
Fig. 2

SAFETY CONTAINER OPENING MEANS

BACKGROUND OF THE INVENTION

This invention relates to a cap and container combination for containing medicine and the like.

In my U.S. Pat. No. 4,095,718, the entire disclosure of which is hereby incorporated by reference, I have disclosed and claimed my invention of a cap adapted to cooperate with a conventional container to provide a precautionary arrangement and to be converted to provide an alternative easy open arrangement.

I have also filed application Ser. No. 924,612, filed July 14, 1978, and entitled "CAP AND CONTAINER IN COMBINATION WITH APPARATUS FOR CONVERTIBLY PROVIDING PRECAUTIONARY AND EASY OPEN ARRANGEMENTS," the entire disclosure of which is hereby incorporated by reference.

Such a precautionary arrangement is characterized by a locking of the cap on the container such that a complex manipulation is required to remove the cap from the container. By making it necessary to perform such a complex manipulation in order to remove the cap from the container, an advantage arises with respect to preventing children from gaining access to the medicine and the like in the container. Although such a precautionary arrangement is advantageous in circumstances where a need for safety exists, it constitutes a nuisance in other circumstances. For example, many elderly people never have small children in their homes. Moreover, such older people may be lacking in manual dexterity and accordingly find it difficult and sometimes impossible to unlock the cap from the container so that they can take the medicine they need. Separately, pharmacists who dispense the medicine fill many containers during a working day and are continually removing and replacing the caps. Owing to the complex manipulations involved in locking and unlocking, done repeatedly, the pharmacists suffer discomfort and irritation to their hands.

SUMMARY OF THE INVENTION

The present invention provides for containing medicine and the like in a combination convertibly providing precautionary and easy open arrangements.

In accordance with a first embodiment of the invention, there is provided a container including a mouth having an inner periphery defining a container access opening. The mouth has an outer circular periphery. The container further includes an externally threaded ring portion having an axially extending notch. A leg depends from the externally threaded ring portion adjacent the notch. The externally threaded ring portion has an underside surface cooperating with the leg to define a corner.

There is further provided a container cap having a cover wall and a side wall projecting from the cover wall to define a container-receiving cylindrical recess. The side wall has an internally threaded ring portion, and a tab axially spaced between the cover wall and the internally threaded ring portion and projecting radially inwardly into the recess. The internally threaded ring portion is positioned on the side wall so that the cap can be twisted onto the container to a point at which the internally threaded ring portion of the cap passes below the externally threaded ring portion of the container.

In accordance with a characterizing feature of the present invention, the first embodiment includes a device for overlying the access opening and for being movable from a first position for the easy open arrangement to a second position for the precautionary arrangement.

The first embodiment further includes resilient means for occupying space between the device and the cover wall so that, in the course of a conversion operation changing from the easy open to the precautionary arrangement, a resilient reaction force must be overcome while pushing the cap to cause the tab to slide through the notch past the depending leg so that further twisting of the cap locks the cap on the container with the tab being lodged in said corner.

In accordance with a second embodiment of the present invention, apparatus is incorporated in a combination for containing medicine and the like. The combination includes a container having a mouth defining a circular access opening, and a container cap having a cover wall and a side wall projecting from the cover wall to define a container-receiving recess. The apparatus releasably secures the cap to the container so as convertibly to define alternative precautionary and easy open arrangements.

In said apparatus, there is provided cooperating locking means for use in the precautionary arrangement to ensure that the cap can be separated from the container only when the cap is aligned in predetermined angular relationship with the container. The locking means includes a pair of tab means on the cap, and locking rim means on the container surrounding the access opening. The locking rim means has a pair of circumferentially spaced apart notches, and each of the tab means projects into the recess from a similarly circumferentially spaced apart portion of the side wall. Each tab means includes a pair of axially spaced apart lugs. The apparatus further includes a member movable within the recess to select between the precautionary and easy open arrangements. Means are provided including said lugs for use in the easy open arrangement to support the member such that the member occupies a plane parallel to and spaced from the cover wall. That plane divides the side wall into a lower skirt-defining portion and an upper portion surrounding a chamber defined between the tab means and the cover wall. A sealing ring is provided on the container parallel to and spaced from the locking rim means such that there is defined, between the locking rim means and the sealing ring, a groove for receiving the tab means in the precautionary arrangement. Further, in the easy open arrangement, the sealing ring contacts the skirt portion of the side wall. The member, while occupying said plane, acts as a stop limiting travel of the container into the recess so that in the easy open arrangement the locking means do not engage. The member is movable into the chamber to enable further travel of the container into the recess so that in the precautionary arrangement the locking means are engageable.

BRIEF DESCRIPTION OF THE DRAWINGS

FIG. 1 is an exploded, perspective view of a combination according to a first embodiment of the present invention;

FIG. 2 is a section view showing an easy open arrangement of the first embodiment;

FIG. 3 is a section view showing a precautionary arrangement of the first embodiment;

DETAILED DESCRIPTION

Figure 4:
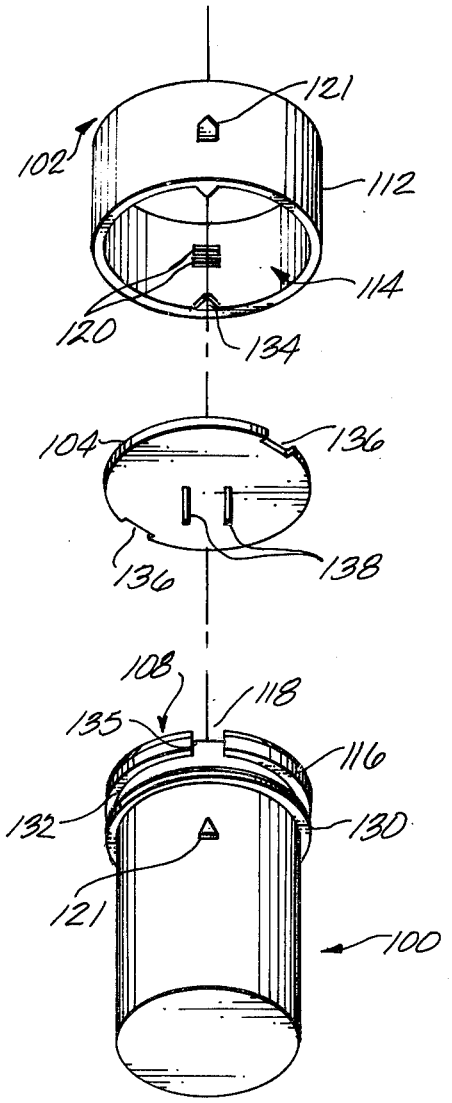
FIG. 4 is an exploded, perspective view of a combination embodying apparatus according to a second embodiment of the present invention.

With reference to FIGS. 1—3, there will be described apparatus according to a first embodiment of the present invention. In accordance with the first embodiment, there are provided a container 10, a cap 12, and a device 14. Container 10 includes a mouth 16 having an inner periphery defining an access opening 18 and having a circular outer periphery. Cap 12 has a cover wall 20 and a side wall 22 projecting from the cover wall to define a container-receiving recess 24.

Device 14 includes a notched disc 26 for overlying access opening 18. In the illustrated embodiment, notches disc 26 has diametrically opposed notches 27.

Further with respect to container 10, there is provided a notched externally threaded ring portion 28. In the illustrated embodiment, externally threaded ring portion 28 has two notches 29, diametrically opposed, and each extending axially. Container 10 further includes a pair of relatively short depending legs 30 adjacent (only one visible) to each corresponding one of notches 29. In the illustrative embodiment, there is also provided a pair of relatively long depending legs 31. Only one of such legs 31 is visible in the drawings and it is on the side of notch 29 opposite from depending leg 30.

Further with respect to cap 12, there is provided an internally threaded ring portion 32 on the interior of side wall 22. A pair of tabs 34, each preferably L-shaped as shown, are each axially spaced between cover wall 20 and internally threaded ring portion 32. Each tab 34 projects radially inwardly into recess 24.

Internally threaded ring portion 32 is positioned on side wall 22 so that cap 12 can be twisted onto container 10 to a point at which internally threaded ring portion 32 passes below externally threaded ring portion 28. FIG. 2 illustrates the arrangement involved at such point. In this arrangement, cap 12 can be easily removed from container 10 simply by twisting it off.

According to a characterizing feature of the present invention, notched disc 26 is movable within recess 24 between a first position, illustrated in FIG. 2, for the easy open arrangement, to a second position, illustrated in FIG. 3, for the precautionary arrangement. The pair of notches 27 facilitate initial installation of notched disc 26 into recess 24. To effect installation, one orients notches 27 into alignment with tabs 34, translates notched disc 26 to clear tabs 34, and then rotates notched disc 26 so that it is retained in recess 24 above tabs 34.

Consider now the features of the first embodiment involved in providing the precautionary arrangement. Further with respect to container 10, the underside 36 of externally threaded ring portion 28 cooperates with leg 30 to define a corner 38. Further, there is provided resilient means for occupying space between notched disc 26 and cover wall 20. In the illustrated embodiment, the resilient means has the form of a spongy member 40 adhesively secured to notched disc 26.

Conversion to the precautionary arrangement (FIG. 3) is effected as follows. First, the cap is twisted onto the container to the point illustrated in FIG. 2 at which internally threaded ring portion 32 has passed externally threaded ring portion 28. Preferably, opposed portions 44 of mouth 16 each taper upwardly to define a stop that the lower portion of the corresponding L-shaped tab 34 butts into when angular alignment of tabs 34 and notches 29 is achieved. Now, by manually pushing the cap downwardly toward the container, the cap translates relative to notched disc 26 and each tab 34 slides through the corresponding notch 29, clears depending leg 30, so that further twisting of cap 12 locks the cap onto the container with each tab 34 being seated in a corresponding corner 38. During this conversion operation, the resilient means acts against cover wall 20 to provide a resilient reaction force that must be overcome while pushing the cap to cause the tabs to slide through the notches past the depending legs.

Further, after the locking operation is completed, and the manual pushing force is discontinued, the resilient means biases the cap upwardly. Thus, if a child were to try to twist the locked cap off, the tabs would be stopped by the depending legs 30, preventing twisting off of the cap. On the other hand, an adult will realize from this positive stopping action that the tabs are adjacent the notches and will accordingly push the cap down to cause the tabs to clear depending legs 30, and then will rotate the cap further. The purpose of the relatively long depending legs 31 is to cause another positive stopping action to alert the adult that pushing should be discontinued. Upon such discontinuance of pushing, the resilient means automatically pushes the cap upwardly, thereby translating the tabs through the notches. Now the cap is unlocked and can be separated from the container simply by further twisting.

Figure 5:
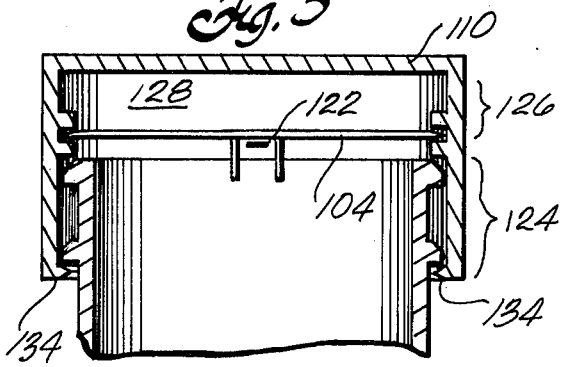
FIG. 5 is a section view showing an easy open arrangement of the second embodiment.
Figure 6:
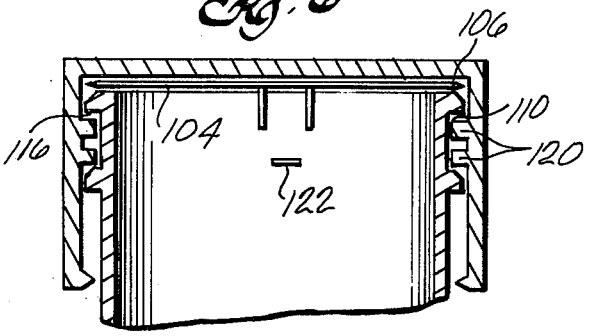
FIG. 6 is a section view showing a precautionary arrangement of the second embodiment.

With reference to FIGS. 4–6, there will now be described apparatus according to a second embodiment of the present invention. In accordance with the second embodiment, there is provided a container 100, a cap 102, and a member 104. Container 100 has a mouth 106 defining a circular access opening 108. Cap 102 has a cover wall 110 and a side wall 112 projecting from the cover wall to define a container-receiving cylindrical recess 114.

Cooperating locking means are provided for use in a precautionary arrangement to ensure that the cap can be separated from the container only when the cap is aligned in predetermined angular relationship with the container. The cooperating locking means are defined by a pair of tab means on the cap, and locking rim means on the container surrounding the access opening. The locking rim means is defined by a locking rim 116 having a pair of circumferentially spaced apart notches 118. Each of the tab means projects into the recess from a circumferentially spaced apart portion of the side wall and each includes a pair of axially spaced apart lugs 120. As is customary, indicators 121 are provided to facilitate alignment of the tab means and the notches.

Supporting means including lugs 120 are used in an easy open arrangement to supoort member 104 such that it occupies a plane parallel to and spaced from cover wall 110. Preferably, the supporting means includes a first and a second lug 122 (only one shown) that are diametrically opposed to each other and serve as ledges to prevent member 104 from wobbling while it is retained between lugs 120. While member 104 is being so retained so as to occupy said plane, the plane divides side will 112 into a lower skirt-defining portion 124, and an upper portion 126 surrounding a chamber 128 defined between the tab means and cover wall 110.

The container has a sealing ring 130 parallel to and spaced from locking rim 116 such that there is defined, between the locking rim and the sealing ring, a groove 132 in which the tab means is contained in the precautionary arrangement. Further, in the easy open arrangement, sealing ring 130 contacts skirt portion 124 of side wall 112.

Member 104, while occupying said plane, acts as a stop limiting travel of the container into the recess so that in the easy open arrangement the locking means do not engage. This is best shown in FIG. 5. On the other hand, member 104 is movable into chamber 128, as best shown in FIG. 6, so as to enable further travel of the container into the recess so that in the precautionary arrangement the locking means are engageable.

In accordance with preferred features of the second embodiment, cap 102 includes a pair of opposed inwardly turned fingers 134 for securely retaining skirt portion 124 to sealing ring 130 in the easy open arrangement (FIG. 5). In this connection, the foregoing components are preferably made of a plastic material. The flexibility of the plastic material facilitates spreading apart of opposed fingers 134 in the course of "snapping" the cap onto and off of the container as fingers 134 move past sealing ring 130. Preferably, a bead 135 extends across each notch 118 so that a similar snapping action is involved in moving the tab means past the notches.

In accordance with a further preferred feature, member 104 has a pair of peripheral notches 136 to facilitate initial installation of member 104 into recess 114. Further, a handle comprising depending portions 138 is provided to facilitate handling of member 104. To install member 104, one orients notches 136 into alignment with the tab means, translates member 104 into the above-mentioned plane, and then rotates member 104 so that it is retained between lugs 120. To convert to the precautionary arrangement, member 104 is manually pushed into chamber 128.

Figure 4A:
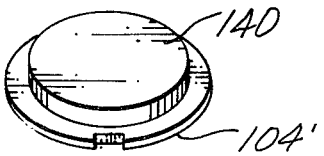
FIG. 4*a* is a perspective view showing a modified element for use in the second embodiment.

An alternative arrangement of member 104 includes as shown in FIG. 4A, a lower disc portion 104' and a spongy portion 140 adhesively secured to disc portion 104'. When the alternative arrangement of member 104 is used, in the combination of FIG. 4, spongy portion 140 is located between disc portion 104' and cover wall 110. In this manner, spongy portion 140 provides a resilient reaction force opposing a pushing action directed to causing the tab means to slide through the notches in the locking rim means. In a specific embodiment of the combination shown in FIG. 4, the components having the following suitable dimensions (in inches): CH=0.133; ZH=0.06; ZS=0.04; SH=0.34; f=0.03; LRH=0.093; GH=0.187; SRH=0.06; LRT=0.105; b=0.015; and CWT=0.05 where CH is the height of chamber 128, ZH is the height of each lug 120, ZS is the vertical spacing between lugs defining a tab, SH is the height of skirt portion 124, f is the projecting length of each finger 134, LRH is the height of locking rim 116, GH is the height of groove 132, SRH is the height of sealing ring 130, LRT is the thickness of lcoking rim 116 measured across the plane defined by mouth 106, b is the thickness of bead 135 extending across notch 118; and CWT is the container wall thickness.

I claim:

1. In a combination for containing medicine and the like, which includes a container having a mouth defining a circular access opening, and a container cap having a cover wall and a side wall projecting from the cover wall to define a container-receiving cylindrical recess, apparatus for releasably securing the cap to the container so as convertibly to define alternative precautionary and easy open arrangements, the apparatus comprising:

cooperating locking means for use in the precautionary arrangement to ensure that the cap can be separated from the container only when the cap is aligned in predetermined angular relationshp with the container, the locking means including a pair of tab means on the cap, and locking rim means on the container surrounding the access opening, the locking rim means having a pair of circumferentially spaced apart notches, each of the tab means projecting into the recess from a circumferentially spaced apart portion of the side wall and each including a pair of axially spaced apart lugs;

a member movable within the recess to select between the precautionary and easy open arrangement;

means including said lugs for use in the easy open arrangement to support the member parallel to and spaced from the cover wall such that the member occupies a plane parallel to and spaced from the cover wall, said plane dividing the side wall into a lower skirt-defining portion and an upper portion surrounding a chamber defined between the tab means and the cover wall;

a sealing ring on the container parallel to and spaced from the locking rim means such that there is defined, between the locking rim means and the sealing ring, a groove for receiving the tab means in the precautionary arrangement and such that, in the easy open arrangement, the sealing ring contacts the skirt portion of the side wall; and the member, while occupying said plane, acting as a stop limiting travel of the container into the recess so that in the easy open arrangement the locking means do not engage, and the member being movable into the chamber to enable further travel of the container into the recess so that in the precautionary arrangement the locking means are engageable.

2. A combination for containing medicine and the like in accordance with alternative easy open and precautionary arrangements, which comprises;

a container including a mouth having an inner periphery defining a container access opening, and having an outer circular periphery, the container further including an externally threaded ring portion having an axially extending notch, the container further including a leg depending from the externally threaded ring portion adjacent the notch, and the externally threaded ring portion having an underside surface cooperating with the leg to define a corner;

a container cap having a cover wall and a side wall projecting from the cover wall to define a container-receiving cylindrical recess, the side wall having an internally threaded ring portion, and having a tab axially spaced between the cover wall and the internally threaded ring portion and projecting radially inwardly into the recess, the internally threaded ring portion being positioned on the side wall so that the cap can be twisted onto the container to a point at which the internally threaded ring portion of the cap passes below the externally threaded ring portion of the container;

a member for overlying the access opening and for being movable within the recess from a first position for the easy open arrangement to a second positon for the precautionary arrangement; and resilient means for occupying space between said member and the cover wall so that, in the course of a conversion operation changing from the easy open to the precautionary arrangement, a resilient reaction force must be overcome while pushing the cap to cause the tab to slide through the notch past the depending leg so that further twisting of the cap locks the cap on the container with the tab being lodged in said corner.

* * * * *

UNITED STATES PATENT AND TRADEMARK OFFICE

CERTIFICATE OF CORRECTION

PATENT NO. : 4,157,142

DATED : June 5, 1979

INVENTOR(S) : CHEUNG T. KONG

It is certified that error appears in the above-identified patent and that said Letters Patent are hereby corrected as shown below:

Column 3, line 23, "notches" should read -- notched --.
Column 4, line 61, "supoort" should read -- support --.
Column 5, line 1, "will" should read -- wall --; line 54, "having" should read -- have --; line 64, "lcoking" should read -- locking --.
Column 6, line 13, claim 1, "relationshp" should read -- relationship --; line 49, claim 2, ";" should be -- : --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*